US008760133B2

(12) United States Patent
Hasegawa et al.

(10) Patent No.: US 8,760,133 B2
(45) Date of Patent: Jun. 24, 2014

(54) LINEAR DROP-OUT REGULATOR CIRCUIT

(75) Inventors: Morihito Hasegawa, Kasugai (JP); Hidenobu Ito, Kasugai (JP); Kwok Fai Hui, Hong Kong (CN); Yat Fong Yung, Hong Kong (CN)

(73) Assignee: Spansion LLC, Sunnyvale, CA (US)

( * ) Notice: Subject to any disclaimer, the term of this patent is extended or adjusted under 35 U.S.C. 154(b) by 528 days.

(21) Appl. No.: 12/255,356

(22) Filed: Oct. 21, 2008

(65) Prior Publication Data

US 2009/0115382 A1 May 7, 2009

(30) Foreign Application Priority Data

Nov. 7, 2007 (JP) ..... 2007-289876

(51) Int. Cl.
*G05F 1/40* (2006.01)

(52) U.S. Cl.
USPC ..... 323/280; 323/273

(58) Field of Classification Search
CPC ..... G05F 1/575
USPC ..... 323/265, 273, 274, 275, 280, 281, 303, 323/311, 313, 314
See application file for complete search history.

(56) References Cited

U.S. PATENT DOCUMENTS

| | | | | |
|---|---|---|---|---|
| 5,850,139 | A * | 12/1998 | Edwards | 323/280 |
| 6,246,221 | B1 * | 6/2001 | Xi | 323/280 |
| 6,300,749 | B1 * | 10/2001 | Castelli et al. | 323/273 |
| 6,465,994 | B1 * | 10/2002 | Xi | 323/274 |
| 6,556,083 | B2 * | 4/2003 | Kadanka | 330/292 |
| 6,677,735 | B2 * | 1/2004 | Xi | 323/273 |
| 6,960,907 | B2 * | 11/2005 | Poss | 323/316 |
| 7,135,912 | B2 * | 11/2006 | Perez | 327/541 |
| 7,449,872 | B2 * | 11/2008 | Zolfaghari | 323/314 |
| 7,557,556 | B2 * | 7/2009 | Nakashimo | 323/299 |
| 7,656,224 | B2 * | 2/2010 | Perez et al. | 327/540 |
| 7,843,180 | B1 * | 11/2010 | Cilingiroglu | 323/274 |
| 8,018,214 | B2 * | 9/2011 | Kwon et al. | 323/271 |
| 8,080,983 | B2 * | 12/2011 | Lourens et al. | 323/275 |
| 2002/0008502 | A1 | 1/2002 | Akiyama et al. | |

(Continued)

FOREIGN PATENT DOCUMENTS

| | | |
|---|---|---|
| JP | 2002-042467 | 2/2002 |
| JP | 2002-042487 | 2/2002 |

(Continued)

OTHER PUBLICATIONS

Ka Chun Kwok et al; "Pole-zero Tracking Frequency Compensation for Low Dropout Regulator"; Circuits and Systems, ISCAS 2002., vol. 4., IV-735-IV-738.
Notification of Reason for Refusal, dated May 8, 2012, 3 pages.
Office Action from JP Application No. 2007-289878, May 8, 2012, Partial Translated Office Action.

*Primary Examiner* — Matthew Nguyen
(74) *Attorney, Agent, or Firm* — Sterne, Kessler, Goldstein & Fox P.L.L.C.

(57) ABSTRACT

According to one aspect of the embodiment, a linear regulator circuit includes an output transistor outputting an output current based on a input voltage, an error amplifier outputting a control signal based on an electric potential difference between an output voltage based on the output current and a reference voltage, a buffer circuit coupled between the error amplifier and the output transistor, and a drive capability adjustment circuit adjusting a load drive capability of the buffer circuit in synchronization with the output current.

20 Claims, 4 Drawing Sheets

(56) References Cited

U.S. PATENT DOCUMENTS

| | | | | |
|---|---|---|---|---|
| 2003/0085693 | A1* | 5/2003 | Marty | 323/280 |
| 2003/0090251 | A1* | 5/2003 | Nakashimo | 323/280 |
| 2003/0111985 | A1* | 6/2003 | Xi | 323/273 |
| 2005/0206444 | A1* | 9/2005 | Perez | 327/540 |
| 2007/0216381 | A1 | 9/2007 | Tsuchiya et al. | |
| 2008/0157735 | A1* | 7/2008 | Liu et al. | 323/280 |

FOREIGN PATENT DOCUMENTS

| | | |
|---|---|---|
| JP | 2003-337627 | 11/2003 |
| JP | 2003-337827 | 11/2003 |
| JP | 2007-249712 A | 9/2007 |

* cited by examiner

LINEAR DROP-OUT REGULATOR CIRCUIT

CROSS-REFERENCE TO RELATED APPLICATIONS

This application claims the benefit of priority of Japanese Patent Application No. 2007-289876 filed on Nov. 7, 2007, the entire contents of which are incorporated herein by reference.

BACKGROUND

1. Field

This application relates to a linear regulator circuit, a linear regulation method, and a semiconductor device.

2. Description of the Related Art

A Low Drop-Out/linear Drop-Out (LDO) regulator circuit is a type of circuit that operates based on an input voltage as a power source and outputs a constant voltage close to the input voltage. An error amplifier detects an output voltage of an output transistor and the output transistor is controlled so that a variation in the output voltage is compensated in response to a detection result of the error amplifier. In addition, there is a need to reduce the variation in the output voltage due to a variation in the input voltage with a high degree of accuracy.

FIG. 1 illustrates a typical LDO circuit discussed in Japanese Laid-open Patent Publication No. 2007-249712. In the above-presented literature, it is discussed that a variation in an output voltage Vo due to a variation in an input voltage Vi may be reduced in response to an operation of an error amplifier 100, and operations of a resistor R3 and a capacitor C3 coupled in series between a supply node of the input voltage Vi and an output terminal of the error amplifier 100. Moreover, it is discussed that a wider bandwidth may be achieved in the error amplifier 100 when a peak of a Power Supply Reduction Ratio (PSRR) characteristic is lowered.

In the LDO circuit in FIG. 1, when the output voltage Vo varies at a high frequency in a condition where an output current flowing through a load from an output transistor Tr101 is increased, operations of the error amplifier 100 and a buffer circuit 102 may be unable to respond to the variation in the output voltage Vo. Due to at least the aforementioned reason, a phase delay increases, and the increase in the phase delay may cause an oscillation in a closed-loop that includes the output transistor Tr101, the error amplifier 100, and the buffer circuit 102.

FIG. 2 illustrates another typical LDO circuit discussed in Ka Chun Kwok et al, "Pole-zero tracking frequency compensation for low dropout regulator", Circuits and Systems, ISCAS 2002. IEEE International Symposium, vol. 4, IV-735-IV-738, 2002. In the above-presented literature, it is discussed that a P-channel MOS transistor Mc, having a resistance value which varies in response to an output voltage of the buffer circuit A2, and a capacitor Cc are coupled in series between an input voltage supply node and an output terminal of a buffer circuit A2. Moreover, it is discussed that an error amplifier having a wider bandwidth is achieved in the LDO circuit in FIG. 2.

In the LDO circuit discussed in FIG. 2, the peak of the PSRR characteristic is reduced based on the operations of the transistor Mc and the capacitor Cc. However, the peak of the PSRR characteristic is not reduced in an area where an ON-resistance of the transistor Mc does not vary linearly, that is, in a condition where an output voltage decreases due to an increase in a load.

SUMMARY

According to one aspect of the embodiment, a linear regulator circuit includes an output transistor outputting an output current based on a input voltage, an error amplifier outputting a control signal based on an electric potential difference between an output voltage based on the output current and a reference voltage, a buffer circuit coupled between the error amplifier and the output transistor, and a drive capability adjustment circuit adjusting a load drive capability of the buffer circuit in synchronization with the output current.

DETAILED DESCRIPTION OF THE EMBODIMENT

Figure 1:
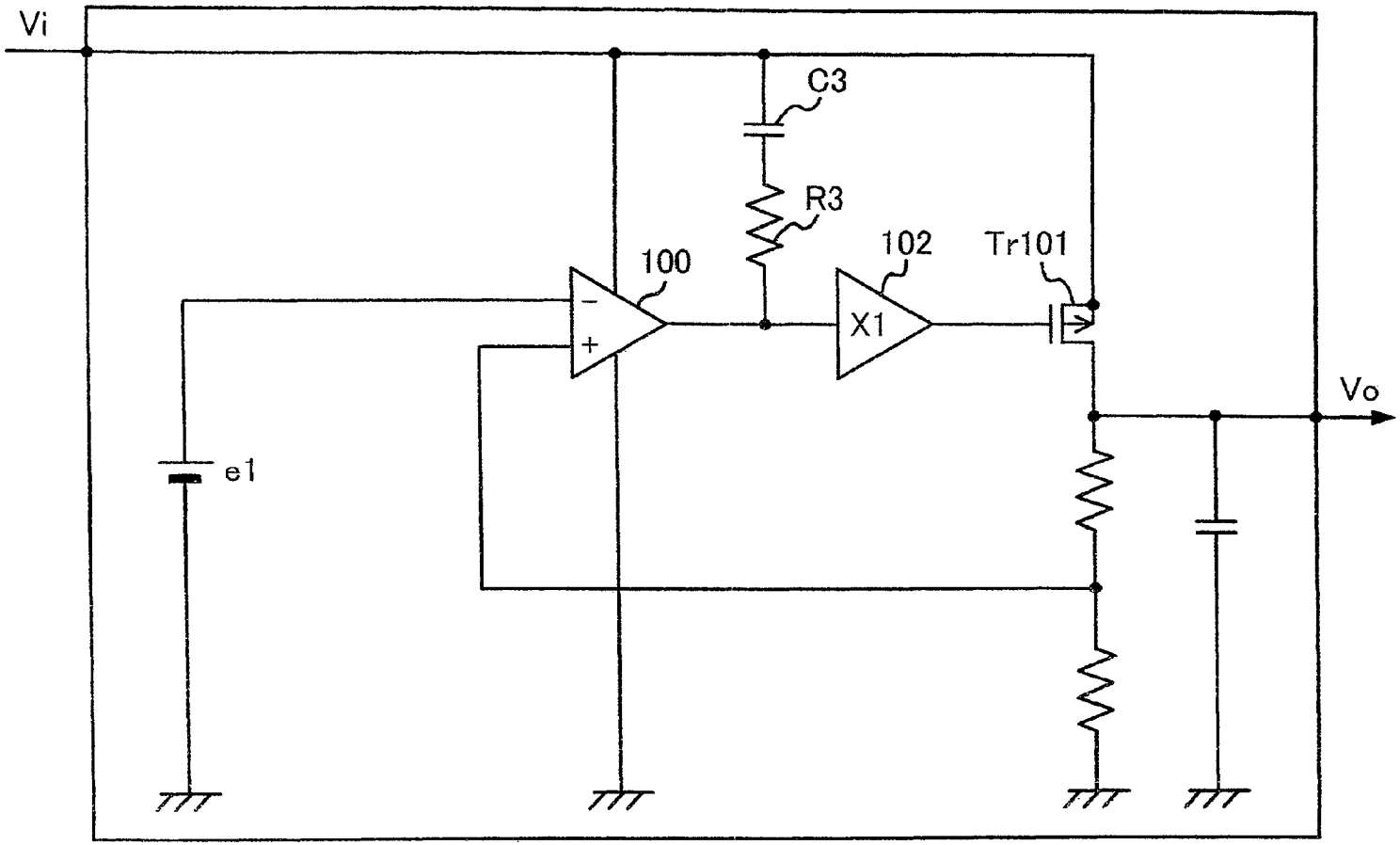
FIG. 1 (RELATED ART)
FIG. 1 illustrates one typical circuit.
Figure 2:
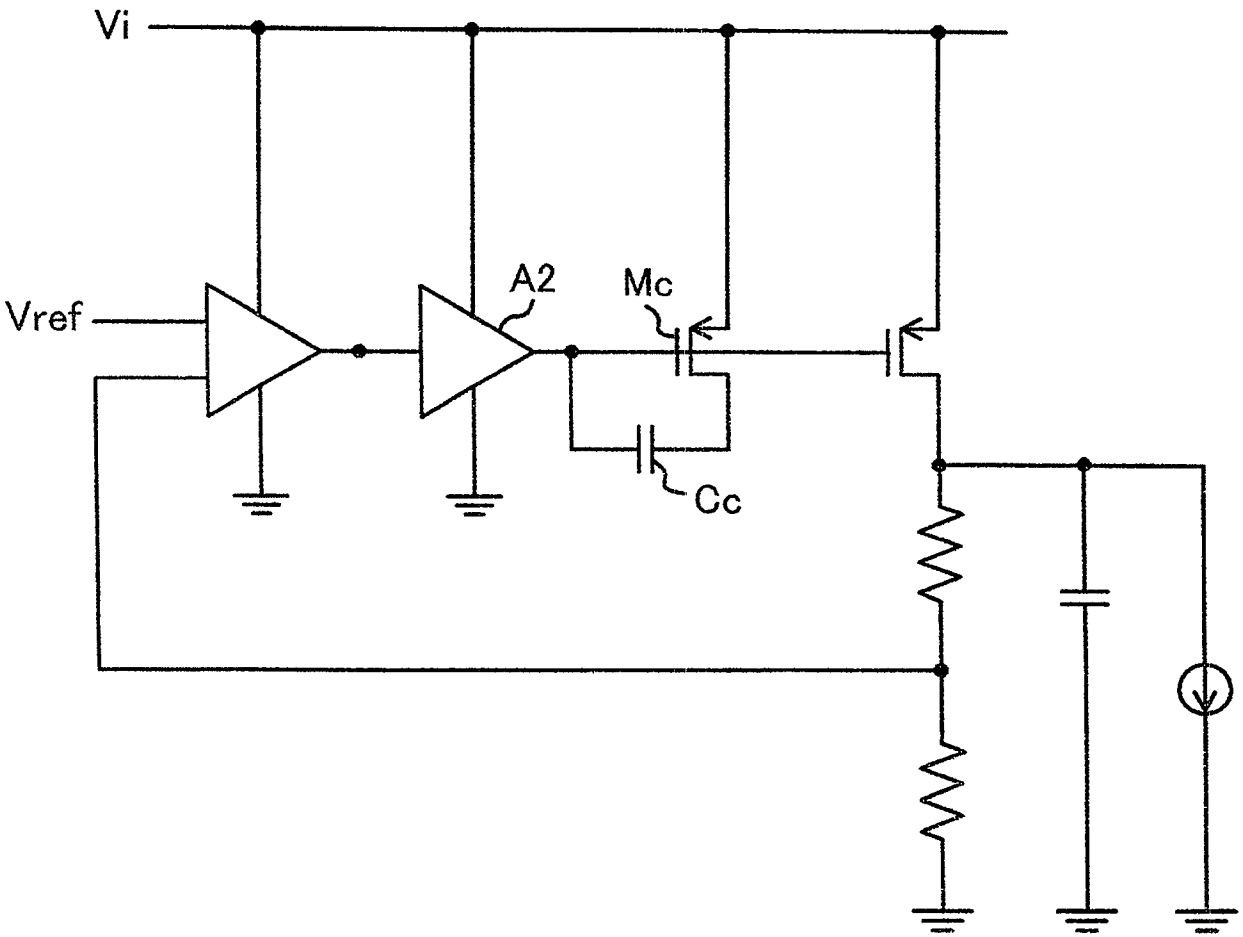
FIG. 2 (RELATED ART)
FIG. 2 illustrates another typical circuit.
Figure 3:
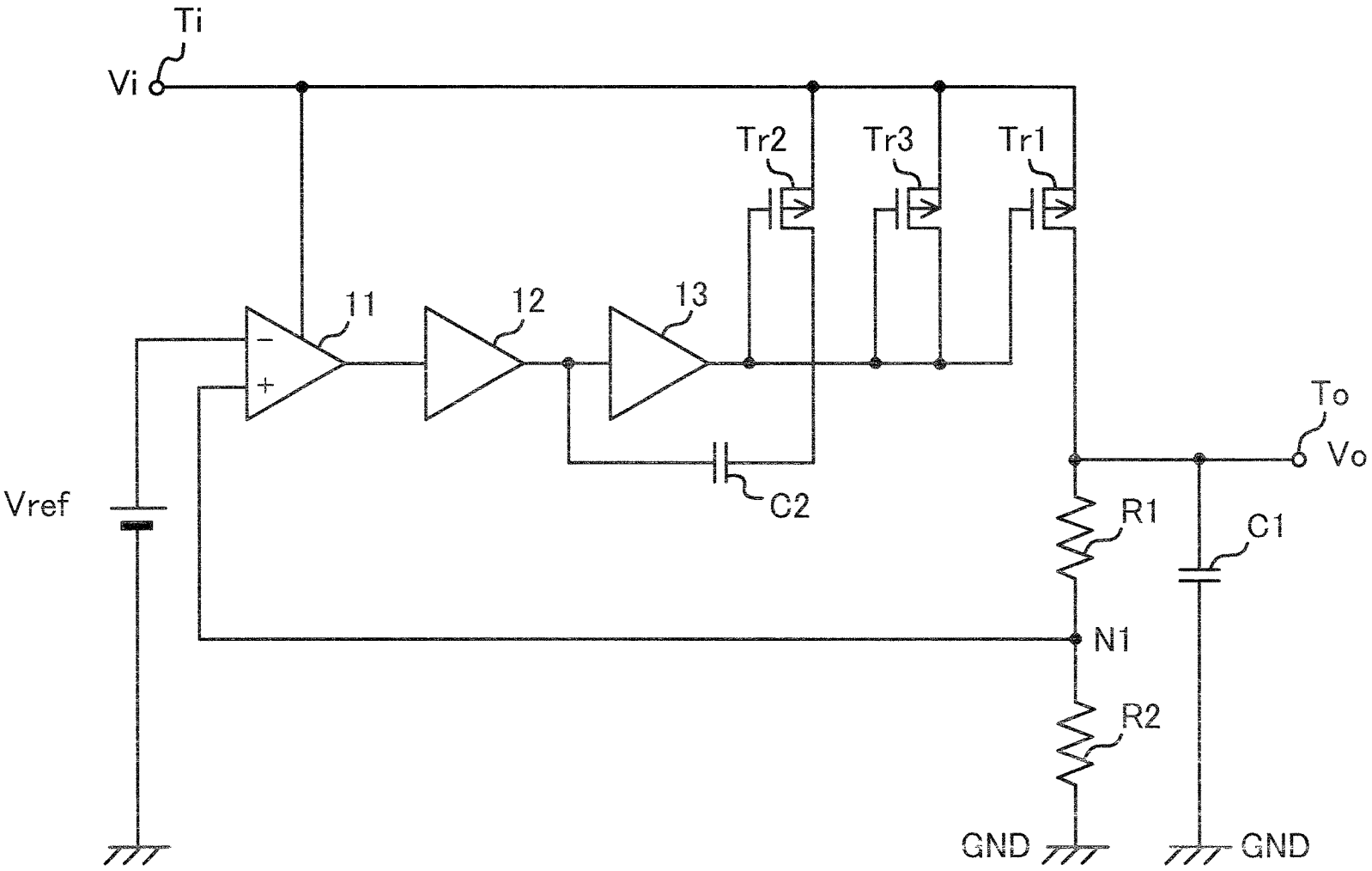
FIG. 3 illustrates an embodiment.

FIG. 3 illustrates an embodiment relating to a Low Drop-Out/Linear Drop-Out (LDO) regulator circuit. An input voltage Vi supplied to an input terminal (input voltage supply node) Ti is supplied, as a power source, to an error amplifier 11. The input voltage Vi is supplied, as the power source, to a source of an output transistor Tr1 that includes a P-channel MOS transistor. An output signal of the error amplifier 11 is input to a gate of the output transistor Tr1 via two stages of buffer circuits including a first buffer circuit 12 and a second buffer circuit 13. Gains of the respective first buffer circuits 12 and second buffer 13 may be, for example, zero.

As further shown in FIG. 3, a resistor R1 and a resistor R2 are coupled between a drain of the output transistor Tr1 and a ground GND. An intermediate node N1 between the resistor R1 and the resistor R2 is coupled to a positive-side input terminal of the error amplifier 11. A reference voltage Vref is input to a negative-side input terminal of the error amplifier 11.

As further shown in FIG. 3, an output voltage Vo is output from an output terminal To coupled to the drain of the output transistor Tr1. A capacitor C1 is coupled between the output terminal To and the ground GND. In the embodiment of FIG. 3, in response to a decrease in the output voltage Vo, an electric potential of the node N1 decreases. In response to the decrease in the electric potential of the node N1, an operation of the error amplifier 11 causes a gate voltage of the output transistor Tr1 to decrease. In response to the decrease in the gate voltage of the output transistor Tr1, an ON-resistance of the output transistor Tr1 decreases. In response to the decrease in the ON-resistance of the output transistor Tr1, the output voltage Vo is pulled up. In response to an increase in the output voltage Vo, the electric potential of the node N1 increases. In response to the increase in the electric potential of the node N1, the operation of the error amplifier 11 causes the gate voltage of the output transistor Tr1 to increase. In response to the increase in the gate voltage of the output transistor Tr1, the ON-resistance of the output transistor Tr1 increases. In response to the increase in the ON-resistance of the output transistor Tr1, the output voltage Vo is pulled down.

The reference voltage Vref may be set, for example, so that the output transistor Tr1 operates in a range where the ON-resistance is low. The capacitor C1 reduces a variation in the output voltage Vo due to a load coupled to the output terminal To.

In the embodiment of FIG. 3, when the variation in the output voltage Vo is reduced by the error amplifier 11 and the capacitor C1, the output voltage Vo with less voltage drop relative to the input voltage Vi is output.

A variation in a low frequency range in the output voltage Vo is reduced with the operation of the error amplifier 11. A variation in a high frequency in the output voltage Vo is reduced by the capacitor C1.

As further shown in FIG. 3, an output terminal of the buffer circuit 13 is coupled to a gate of a second P-channel MOS transistor Tr2. The input voltage Vi is supplied to a source of the transistor Tr2. A drain of the transistor Tr2 is coupled to a coupling node of the buffer circuits 12 and 13 via a capacitor C2. An ON-resistance of the transistor Tr2 decreases in response to a decrease in an output voltage of the buffer circuit 13 and increases in response to an increase in the output voltage of the buffer circuit 13.

As further shown in FIG. 3, the output terminal of the buffer circuit 13 is coupled to a gate and a drain of a first P-channel MOS transistor (drive capability adjustment circuit) Tr3. The input voltage Vi is supplied to a source of the transistor Tr3.

As further shown in FIG. 3, in response to the decrease in the output voltage of the buffer circuit 13, an ON-resistance of the transistor Tr3 decreases. The decrease in the ON-resistance of the transistor Tr3 causes a drain current supplied to the buffer circuit 13 to increase. Both of the buffer circuits 12 and 13 may have the same circuit configuration. Exemplary buffer circuit 13 is disclosed with reference to FIG. 4.

Figure 4:
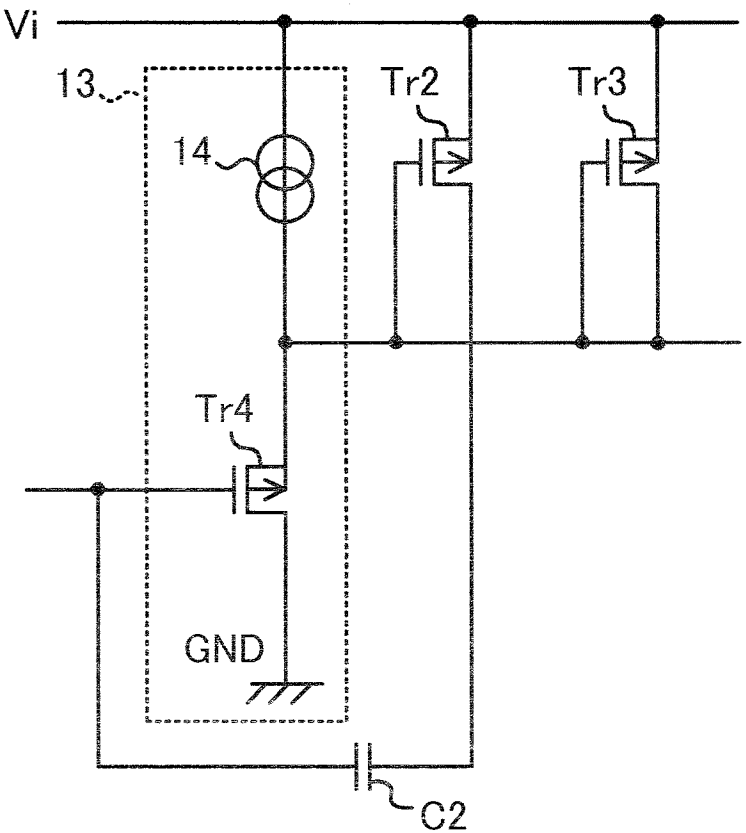
FIG. 4 illustrates a buffer circuit of FIG. 3.

As shown in FIG. 4, the buffer circuit 13 includes a P-channel MOS transistor Tr4 and a current source 14. An input signal is input to a gate of the P-channel MOS transistor Tr4. A constant current is supplied from the current source 14 to a source of the transistor Tr4. A drain of the transistor Tr4 is coupled to a ground GND. The source of the transistor Tr4 is coupled to the gate of the output transistor Tr1, the gate of the transistor Tr2, the gate of the transistor Tr3, and the drain of the transistor Tr3.

In the embodiment of FIG. 3, in response to a decrease in an input voltage of the buffer circuit 13 in FIG. 4, an ON-resistance of the transistor Tr4 decreases. In response to the decrease in the ON-resistance of the transistor Tr4, the output voltage of the buffer circuit 13, that is, a source voltage of the transistor Tr4, decreases. In response to an increase in the input voltage of the buffer circuit 13, the ON-resistance of the transistor Tr4 increases. In response to the increase in the ON-resistance of the transistor Tr4, the output voltage of the buffer circuit 13 increases.

As further shown in FIG. 4, a drain current of the transistor Tr3 is absorbed as a drain current of the transistor Tr4. Along with the increase in the drain current, a load drive capability of the transistor Tr4 increases.

The embodiment in FIG. 3 has the following advantages, for example.

(1) In response to the decrease in the output voltage Vo, the electric potential of the node N1 decreases. In response to the decrease in the electric potential of the node N1, the operation of the error amplifier 11 causes the gate voltage of the output transistor Tr1 to decrease. In response to the decrease in the gate voltage of the output transistor Tr1, the ON-resistance of the output transistor Tr1 decreases. In response to the decrease in the ON-resistance of the output transistor Tr1, the output voltage Vo is pulled up. In response to the increase in the output voltage Vo, the electric potential of the node N1 increases. In response to the increase in the electric potential of the node N1, the operation of the error amplifier 11 causes the gate voltage of the output transistor Tr1 to increase. In response to the increase in the gate voltage of the output transistor Tr1, the ON-resistance of the output transistor Tr1 increases. In response to the increase in the ON-resistance of the output transistor Tr1, the output voltage Vo is pulled down. In response to the operations disclosed above, the variation in the output voltage Vo is reduced.

(2) The P-channel MOS transistor Tr2 and the capacitor C2 are coupled in series between the supply node of the input voltage Vi and the coupling node located between buffer circuits 12 and 13, and the gate of the transistor Tr2 is coupled to the output terminal of the buffer circuit 13. The aforementioned circuit configuration allows a peak of a PSRR characteristic to be reduced.

(3) The P-channel MOS transistor Tr3 is coupled between the supply node of the input voltage Vi and the output terminal of the buffer circuit 13 and the gate of the transistor Tr3 is coupled to the output terminal of the buffer circuit 13. The aforementioned circuit configuration allows the transistor Tr3 to operate as a variable resistor having an ON-resistance which varies in response to the output voltage of the buffer circuit 13.

In response to the decrease in the output voltage of the buffer circuit 13, that is, in response to the increase in the output current of the output transistor Tr1 based on the increase in the load, the drain current of the transistor Tr3 supplied to the buffer circuit 13 increases.

In response to the increase in the output current of the output transistor Tr1, the drain current of the transistor Tr4 included in the buffer circuit 13 increases. As a result thereof, a load drive capability of the buffer circuit 13 increases.

(4) In response to the increase in the output current of the output transistor Tr1, the load drive capability of the buffer circuit 13 increases. As a result thereof, a frequency causing a phase delay that causes oscillation of the error amplifier 11 becomes a higher frequency. That is, a phase margin to prevent the oscillation increases.

(5) The two stages of buffer circuits (the first buffer circuit 12 and the second buffer circuit 13) are coupled in series and a series circuit that includes the transistor Tr2 and the capacitor C2 is coupled to the coupling node located between the buffer circuits 12 and 13. The aforementioned circuit configuration prevents the load drive capability of the buffer circuit 13 from being decreased by the series circuit including the transistor Tr2 and the capacitor C2.

(6) The series circuit including the transistor Tr2 and the capacitor C2 is coupled to the coupling node located between the buffer circuits 12 and 13. The aforementioned circuit configuration prevents the series circuit that includes the transistor Tr2 and the capacitor C2 from functioning as a load of the error amplifier 11. Consequently, the operation of the error amplifier 11 substantially speeds up.

In the aforementioned embodiment, the buffer circuit 12 may be omitted.

Even if the buffer circuit 12 and the series circuit including the transistor Tr2 and the capacitor C2 are omitted, the load drive capability of the buffer circuit 13 is increased by the transistor Tr3. In consequence, the phase margin increases.

The aforementioned embodiment increases the phase margin to prevent the oscillation.

Although a few embodiments have been shown and described, it would be appreciated by those skilled in the art that changes might be made in these embodiments without departing from the principles and spirit of the invention, the scope of which is defined in the claims and their equivalents.

What is claimed is:

1. An apparatus comprising:

an error amplifier circuit;

a first buffer circuit connected to an output terminal of the error amplifier circuit;

a second buffer circuit connected to an output terminal of the first buffer circuit, wherein an output terminal of the second buffer circuit comprises an internal node;

a drive capability adjustment circuit including a first transistor coupled between a voltage input node and the internal node; and a series circuit, including a second transistor and a capacitor, wherein a control terminal of the second transistor is connected to the internal node, a first terminal of the capacitor is connected to the output terminal of the first buffer circuit and a second terminal of the capacitor is connected to another terminal of the second transistor.

2. The apparatus according to claim 1, wherein the first transistor is a MOS transistor with a gate terminal and a drain terminal connected to the output terminal of the second buffer circuit.

3. The apparatus according to claim 2, wherein the gate terminal of the MOS transistor and a gate terminal of an output MOS transistor are connected to the output terminal of the second buffer circuit.

4. The apparatus according to claim 1, wherein the first transistor is a MOS transistor with a source terminal connected to the voltage input node and a gate terminal and a drain terminal connected to the output terminal of the second buffer circuit.

5. The apparatus according to claim 1, wherein the first transistor is a variable resistor configured to adjust a current supplied to the second buffer circuit based on a change in an output current.

6. The apparatus according to claim 1, wherein the first transistor is a P-channel MOS transistor.

7. The apparatus according to claim 1, wherein the second transistor is a MOS transistor with a gate terminal connected to the output terminal of the second buffer circuit.

8. The apparatus according to claim 1, wherein the first transistor is a MOS transistor with a source terminal connected to the voltage input node.

9. The apparatus according to claim 1, wherein the first buffer circuit includes an input terminal connected to the output terminal of the error amplifier circuit.

10. The apparatus according to claim 1, wherein the error amplifier circuit is configured to output a control signal based on an electric potential difference between an output voltage and a reference voltage.

11. The apparatus according to claim 1, further comprising:

an output transistor configured to output a current based on an input voltage applied at a control terminal of the output transistor.

12. The apparatus according to claim 1, wherein the series circuit is configured to reduce a peak of a Power Supply Rejection Ratio (PSRR) characteristic of the apparatus.

13. A system comprising:

an error amplifier circuit;

a first buffer circuit connected to an output terminal of the error amplifier circuit;

a second buffer circuit connected to an output terminal of the first buffer circuit, wherein an output terminal of the second buffer circuit comprises an internal node;

a drive capability adjustment circuit including a first transistor coupled between a voltage input node and an internal node;

a series circuit, including a second transistor and a capacitor, wherein a control terminal of the second transistor is connected to the internal node, a first terminal of the capacitor is connected to the output terminal of the first buffer circuit and a second terminal of the capacitor is connected to another terminal of the second transistor; and a feedback circuit coupled to an input of the error amplifier circuit.

14. The semiconductor device according to claim 13, wherein the first transistor is a P-channel MOS transistor.

15. The apparatus according to claim 13, wherein the second transistor is a P-channel MOS (PMOS) transistor, wherein a source terminal of the PMOS transistor is connected to the voltage input node.

16. The semiconductor device according to claim 13, wherein the first transistor is a MOS transistor with a source terminal connected to the voltage input node and a gate terminal and a drain terminal connected to the output terminal of the second buffer circuit.

17. A method comprising:

outputting, with an error amplifier circuit, a control signal based on an electric potential difference between an output voltage based on an output current and a reference voltage to a first buffer circuit connected to an output terminal of the error amplifier circuit; and adjusting a load drive capability of a second buffer circuit, connected to an output terminal of the first buffer circuit, based on the output current with:

a first transistor coupled between a voltage input node and an output terminal of the second buffer circuit that comprises an internal node; and a series circuit including a capacitor and a second transistor, wherein a control terminal of the second transistor is connected to the internal node, a first terminal of the capacitor is connected to the output terminal of the first buffer circuit and a second terminal of the capacitor is connected to another terminal of the second transistor.

18. The method according to claim 17, wherein the first transistor is a MOS transistor with a source terminal connected to the voltage input node and a gate terminal and a drain terminal connected to the output terminal of the second buffer circuit.

19. The method according to claim 17, wherein the first transistor is a variable resistor configured to adjust a current supplied to the second buffer circuit based on a change in an output current.

20. The method according to claim 17, wherein the second transistor is a P-channel MOS (PMOS) transistor, wherein a source terminal of the PMOS transistor is connected to the voltage input node.

* * * * *